United States Patent [19]

Lundstrom

[11] Patent Number: 4,645,625

[45] Date of Patent: Feb. 24, 1987

[54] DECONTAMINATION OF A RADIOACTIVE WASTE LIQUID BY ELECTRODIALYSIS

[75] Inventor: Jerry E. Lundstrom, Pelham, N.H.

[73] Assignee: Ionics, Incorporated, Watertown, Mass.

[21] Appl. No.: 675,052

[22] Filed: Nov. 26, 1984

[51] Int. Cl.[4] ..... G21F 9/08

[52] U.S. Cl. ..... 252/631; 204/182.4; 204/301; 376/310

[58] Field of Search ..... 376/310; 204/301, 182.4; 210/748; 252/631

[56] References Cited

U.S. PATENT DOCUMENTS 3,296,112 1/1967 Kollsman ..... 204/182.4

3,847,765 11/1974 Uno et al. ..... 204/182.4 X 3,968,017 7/1976 Canata et al. ..... 204/301 X 4,324,629 4/1982 Oka et al. ..... 204/182.4

*Primary Examiner*—Deborah L. Kyle

*Assistant Examiner*—John S. Maples

*Attorney, Agent, or Firm*—Norman E. Saliba

[57] ABSTRACT

This invention relates to apparatus and processes for the removal and recovery of concentrated acid such as $HNO_3$ and radioactive cations such as cesium ($Cs^+$) from a radioactive acidic waste stream resulting in the recovery of a decontaminated water product. The invention employs a combination of membrane electrodialysis stacks with each having its own specific cell configuration for performing a specific salt removal or salt concentrating step in the decontamination process.

11 Claims, 1 Drawing Figure

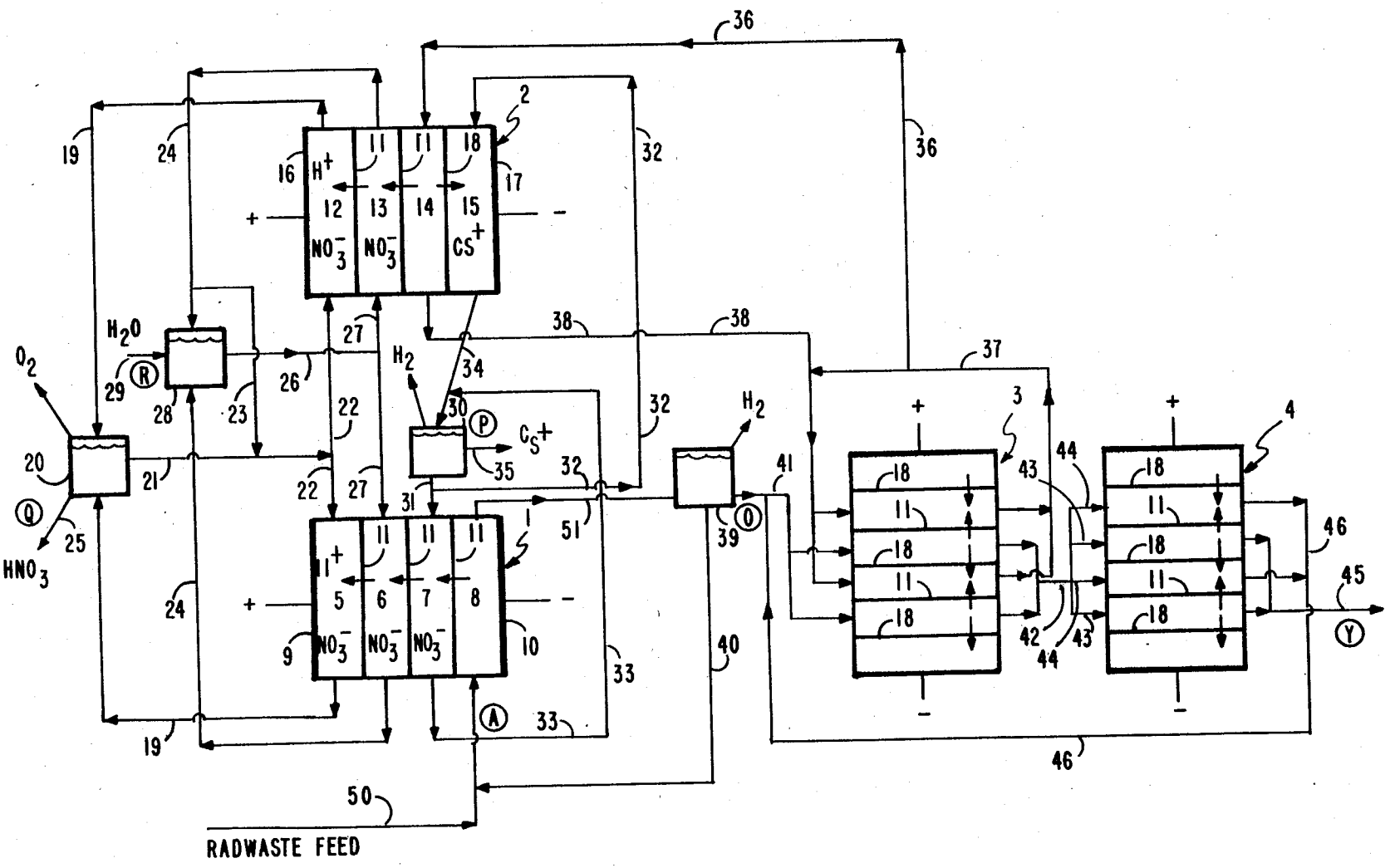
RADWASTE FEED
$H_2O$
$O_2$
$HNO_3$
$H_2$
$Cs^+$
$H^+$
$NO_3^-$

DECONTAMINATION OF A RADIOACTIVE WASTE LIQUID BY ELECTRODIALYSIS

BACKGROUND OF THE INVENTION

1. Field of the Invention

This invention concerns the use of electrodialysis for the separation and concentration of ions from radioactive waste (radwaste) solutions. In particular it is directed to employing a plurality of electrochemical and electrodialysis units or stacks in a novel combination to concentrate radioactive cations from low level acidic solutions that result from dissolving irradiated fuel from nuclear reactors in solvents such as nitric acid.

2. Prior Art

The removal, separation and/or recovery of radioactive ions from waste solutions by employing ion-exchange resin columns is well known in the art. U.S. Patents disclosing the use of ion-exchange resin are for example Nos. 4,434,138 4,423,159, 4,423,008, 4,397,819, 4,312,838, 2,752,309, 2,554,649 and many others. However, the absorption by ion-exchange is an expensive process and in practice is applicable to solutions which are very slightly loaded with salt ions. Additionally ion-exchange resin operation requires regeneration or replacement of the exhausted resin.

It is further known that electrodialysis can be employed to separate out cesium, cerium, zirconium and uranium values from each other. U.S. Pat. No. 3,038,844 describes a method and apparatus for this purpose. However, such disclosed process employs a single electrodialysis stack which does not result in obtaining a sufficiently high deacidification and/or decontamination factor and which generally operates at a low current efficiency.

SUMMARY OF THE INVENTION

It is a general object of the present invention to provide a novel and improved electrodialysis apparatus and process for the deacidification and decontamination of an acidic radwaste stream. It a further object to obtain a decontamination factor of about 100 or greater of a radwaste stream containing about 40 picocuries of radioactivity/ml. and about 0.1 to 0.3 normal nitric acid. It is further object to concentrate the cation radioisotopes to as small a liquid volume as possible, preferably about less than 10% of the initial radwaste stream volume with a water volume product recovery of preferably greater than 90%. It is a further object to separate out the acid from the cation radioactivity to reduce the base required to neutralize the resulting concentrated radioactive waste and to further recover the acid for possible reuse.

How these and other objects and advantages of the present invention are accomplished will become apparent from the detailed description taken with the accompanying drawing. Generally however in preferred form, the invention comprises providing a combination of various electrochemical and electrodialysis stacks, with each stack having its own specific cell configuration.

DESCRIPTION OF THE DRAWING

The single drawing illustrates a flow diagram and schematic cross-sectional representation of the combination apparatus used in performing the process of the invention.

DESCRIPTION OF THE PREFERRED EMBODIMENT

Referring to the drawing there is shown a pair of four chamber electrodialysis stacks i.e. a deacidification stack 1, a radioactive cation concentration stack 2 and a pair of multichamber salt concentrating and diluting (C and D) electrodialysis stacks 3 and 4. Generally each stack is composed of an anode and cathode electrode terminally positioned within the stack and a plurality of liquid treating chambers therebetween defined and separated from each other by ion-permeable membranes. The anodes and cathodes used may be any of those normally employed in electrolytic cells.

The deacidification stack 1 as shown is made up of four compartments or chambers; i.e. an anode chamber 5 containing an anode electrode 9, two neutral chambers 6, 7 and a cathode chamber 8 with its attendant cathode electrode 10. The chambers are defined and separated from each other by all anion selective membranes 11 which will, in principle, only allow the passage of anions, negatively charged ions, i.e. $NO_3^-$ toward the positive electrode 9 as shown by the direction of the arrows. In practice, the efficiency of the anion selective membrane 11 separating the cathode chamber 8 from adjacent chamber 7 is dependent upon the acid concentration in said adjacent chamber. The preferred stack design provides for the solution adjacent to the cathode chamber of the deacidification stack 1 to be of low acidity so as to enhance the net deacidification accomplished in the cathode compartment 8. In the system shown in the drawing, this low acidity solution is in fact the catholyte effluent stream from the concentration stack 2 which solution is continuously deacidified in said stack 2 as it accumulates the radioactive cations, such as cesium. Depending on the rate of make-up water addition (and the acidity of the make-up water stream), the overall acidity of the catholyte stream of the concentration stack 2 can be increased or decreased relative to the acidity of the solution passing through the cathode chamber 8 of the deacidification stack 1. Except for the net passage of hydrogen ion through the separating anion membrane (which varies as described above) the chamber 7 adjacent to the cathode compartment 8 in stack 1 behaves as neutral chamber. A neutral chamber is defined herein as a chamber that neither concentrates salt nor dilutes (removes) salt therein. Because a neutral chamber is defined on both sides by membranes of the same charge i.e. both cation selective or anion selective membranes, the salt ions that pass into the chamber will also pass out of the chamber and thus there is substantially no net gain or loss of ions therein.

The radioactive cation concentration stack 2 is of similar construction as the deacidification stack 1 in also having four chambers, i.e. anode and cathode chambers 12, 15 with their respective anode electrode 16 and cathode electrode 17, a neutral chamber 13 and a single salt diluting or separating chamber 14. The cation concentration stack 2 differs from the deacidification stack 1 in that a cation selective membrane 18 is placed adjacent to the cathode chamber 15 thus forming a single salt diluting (reducing) chamber 14 and allowing the cathode chamber 15 to act as a cation concentration chamber, with the cations ($Cs^+$) and anions ($NO_3^-$) flowing in the direction of the arrows as shown. A significant feature of this design is that the radioactive cations reach the catholyte stream of the concentration stack 2 only by way of the brine stream 36 from the primary desalting stack 3. Since the brine stream is also deacidified by the concentration stack 2, both hydrogen ions and the radioactive cations pass into the catholyte stream of stack 2.

The concentration ratio of radioactive cations to acid in the brine stream 36 determines to a large extent the percent water recovery of the plant and the ultimate concentration factor for the radioactive cations. Namely, the transfer of hydrogen ions to the catholyte of the concentration stack 2 is accompanied by the transfer of water by electroosmosis. Typically, 0.1 liter of water is transferred per equivalent of hydrogen ion so that if the acid concentration entering as feed to the primary desalting stack 3 is 0.1N (0.1 equivalents/liter), then the ultimate transfer of this acid to the catholyte stream of the concentration stack 2 will carry with it 0.01 liters per liter of feed. In this case, the maximum water recovery (water leaving as decontaminated water out of the secondary desalting stack 4) is 99 percent and, assuming equal transfer of the radioactive cations relative to the number of equivalents per liter in the feed, the maximum concentration factor for the radioactive cations is 100.

In a second case where the feed to the primary desalting stack 3 is 0.5N acid, the water transferred to the catholyte of the concentration stack 2 with the acid, is 0.05 liters per liter of feed. The corresponding water recovery and maximum concentration factor are 95% and 20% respectively.

By using the catholyte effluent stream of the concentration stack 2 as the low acidity feed stream to the compartment 7 adjacent to the cathode compartment 8 in the deacidification stack 1 additional acid and the associated water by electroosmosis accumulates in the catholyte stream. The net effect is, in practice, to increase the water transfer by 20% or more and to reduce the maximum concentration factors from the 100 and 20 given in the above illustrations by a similar 20% or more. This effect is enhanced as the acidity of the make-up stream 26 increases.

The combination, therefore, of the deacidification stack 1 (to control the acidity of the feed) and the primary desalting stack 3 is an essential feature of the process. Deacidification of the feed in stack 1 both improves the ratio of radioactive cations to acid (because the acid is electrochemically neutralized) and improves the ultimate concentration factor (and water recovery) of the process.

In the practice of the invention, the pair of stacks containing four chambers (or more) as described above is preferred. However, three chamber stacks consisting of a single middle chamber between the electrode chambers may be employed although not as efficiently. Thus the deacidification stack 1 could use a pair of anion membranes to define a single middle chamber from the adjacent electrode chambers. In turn the middle chamber of the cation concentration stack 2 could be positioned from the anode and cathode chambers by an anion and cation membrane respectively to form a single salt diluting chamber 14.

The electrodialysis (desalting) stacks 3, 4 are shown substantially as two cell pair stacks having arrows which illustrate the direction of salt flow from the diluting stream to the salt concentrating stream. As is well-known in the art each stack is composed of a cathode and anode positioned respectively at each end of the stack and a plurality of alternating cation 18 and anion 11 selective membranes therebetween to form a series of alternating salt diluting (reducing) chambers and salt concentrating chambers. These stacks function to separate out the salts (nitric acid and radioisotopes) from the radwaste stream entering the diluting chambers and simultaneously concentrating these salts in the concentrating chambers. The radwaste mixture passes through desalting chambers defined between alternating cation membranes and anion membranes, held and separated in a stack arrangement by means well-known in the prior art. Tortuous path spacer compartments of the type disclosed in U.S. Pat. Nos. 2,708,658 and 2,891,899 can be employed to separate the membranes from each other to form alternating desalting and concentrating chambers or compartments. The combination of a desalting and concentrating chamber constitutes a cell pair. Any number of cell pairs can be stacked between a pair of end electrodes to produce a demineralization stack containing typically 100 cell pairs or more. Each electrical stage may in turn contain one or more hydraulic stages as is well-known in the art. Such systems are more fully described in U.S. Pat. Nos. 2,694,680; 2,752,306; 2,848,403; 2,981,899; 3,003,940; 3,341,441; and 3,412,006. The manufacture and properties of ion-selective mambranes of the type employed in electrodialysis systems are fully discussed in U.S. Pat. Nos. Re. 24,865, 2,730,768; 2,702,272; 2,731,411; 4,231,855; 4,373,031 and many others. Under the influence of an electrical potential across the cell, positively charged radioactive ions such as cesium and strontium migrate through the cation membranes into the waste compartments to form a concentrate (brine) stream. Similarly, negatively charged ions such as nitrate ($NO_3^-$) pass through the anion membranes into the waste compartments to form a salt concentrating stream. Although the above mentioned ions comprise the main body of the salts in the present embodiment, other ionic substances are or may also be removed in a like manner. Additionally, in the operation of the electrodialysis cell, a recirculating electrolyte stream is normally passed in contact with the cathode and a similar stream in contact with the anode.

In operation of the process, the acidic radwaste liquid to be processed is passed from a waste line 50 directly into the cathode chamber 8 of the deacidification stack 1 where substantial deacidification of the acidic waste stream occurs. Under an impressed current, hydrogen ions ($H^+$) in the cathode compartment are converted to hydrogen gas ($2H^+ + 2e^- \rightarrow H_2 \uparrow$) and the nitrate ions ($NO_3^-$) are transferred through the neutral chambers 6, 7 via the anion membranes 11 finally ending up in the anode compartment 5. This passage of $NO_3^-$ also occurs in the cation concentration stack 2 in like manner finally ending up in the anode compartment 12 as shown by the direction of the arrows. In the anode chambers 5, 12, the nitrate ions combine with the hydrogen ions generated at the anodes ($H_2O \rightarrow 2H^+ + \frac{1}{2}O_2 + 2e^-$) to form nitric acid. The acid is passed from an acid hold-up tank 20 via a common feed line 21 which splits into a separate feed line 22 going to each anode chamber. Make-up water is added into this recirculating anolyte stream preferably at the common feed line 21 by way of a bleed line 23 which taps-off from the line 24 carrying effluent from the neutral chambers 6, 13. The addition of make-up water to the anolyte recirculating stream will allow for control of the acid build-up in the hold-up tank 20. Acid is recovered at the desired concentration from the hold-up tank 20 by way of bleed line 25 and may be reused. The maximum acid content in the anolyte hold-up tank 20 is preferably maintained at about between 1–1.5 normal by control of the addition of make-up water to the recirculating anolyte loop. The make-up water requirement will be largely determined by the initial concentration of acid in the radwaste stream.

The four chamber stack pair 1, 2 also share a common feed stream 26 which splits into two feed streams 27, with each stream being recycled through the neutral chambers 6, 13 into a water hold-up tank 28 to which make-up water is added via a water line 29.

In the deacidification stack 1, the neutral chamber 7 immediately adjacent to the cathode chamber 8 is fed with catholyte solution from a catholyte collection tank 30. From below this tank, two streams 31, 32 emerge; one stream 31, passing into and out of the neutral chamber 7 and recirculating back into the catholyte collection tank 30 via line 33. The other stream 32 recirculates back through the cathode chamber 15 of stack 2 and collects again in the catholyte tank 30 via a recirculating line 34. The cathode chamber 15 of the cation concentration stack 2 which is defined from the immediately adjacent single salt diluting chamber 14 by a cation selective membrane 18 functions as a cation concentrating chamber where the positively charged radioactive cations from the adjacent single diluting chamber 14 are received and collected. The catholyte solution is removed from the catholyte tank 30 via a bleed line 35 and prepared either for disposal or further concentration as may be required.

Normally there is no make-up water to the catholyte stream. However, the catholyte of the concentrating stack 2 will gain water due primarily to electroosmosis as the cations of $H^+$, $Cs^+$, etc. migrate into the cathode chamber 15. For example, it has been determined that the electroosmotic coefficient of the hydrogen ion ($H^+$) is about 0.1 liters of water per equivalent of current passed. For other cations, the coefficient is about 0.25 liters per equivalent. Thus, when the feed solution to the single diluting chamber 14 of the concentration stack 2 is 0.1N in acid, water transport through the cation membrane 18 into the adjacent cathode chamber 15 is in the order of about 1% of the feed rate. Water transport to the cathode chamber 18 can also be influenced by the relative pressure differential between the cathode chamber 15 and the adjacent salt diluting chamber 14. For example, with the cathode compartment overpressurized and at a pressure differential of 5–10 psi, water transport into the catholyte stream will determine the ultimate concentration factor of the radiosotopes. The present invention can process radwaste feed streams containing high acid concentrations but the product rates will be reduced if the decontaminated product water is maintained at the low 0.001 acid normality.

In the concentration stack 2, the feed stream 36 to the single salt diluting chamber 14 contained therein comprises a concentrated salt solution obtained from the recirculating salt concentrate loop 37 of the primary desalting stack or unit 3. This single diluting compartment 14 will partially deacidify and deionize the concentrated salt stream 36 with the resulting treated stream 38 being cycled back as influent to the concentrating feed stream of the primary stack 3.

As previously stated, the radwaste liquid is initially treated in the cathode chamber 8 of the deacidification stack 1 to effect partial deacidification of the waste liquid stream. The resulting effluent catholyte stream is thereafter passed into a hold-up tank 39 via an effluent line 51 where the release of hydrogen gas occurs. From this tank 39, two streams 40, 41 emerge. One stream 40 is combined with the radwaste feed stream 50 and thus recycled back through the cathode chamber 8. The other stream 41 passes as the dilute influent stream to the primary desalting stack 3. The dilute effluent stream 42 from the primary stack is then split into two streams 43, 44; one stream 43 passing as the dilute influent stream to the secondary desalting stack 4 and exiting as a deacidified and decontaminated product water stream 45. The other stream 44 is passed into the stack as the concentrating influent stream and removed as the effluent stream via line 46 where it is recycled back and combined with the dilute influent feed line 41 to the primary stack 3.

The operation and conception of the invention will be further understood from the following example:

EXAMPLE I

This example illustrates the treatment of an acidic radwaste solution comprised of 0.27 normal nitric acid and a concentration of $0.27\times10^{-10}$ normal in cesium ions to result in a 100 fold reduction of cesium. The waste solution is fed into the cathode chamber 8 of the deacidification stack 1 at a flow rate of 289 ml. per minute. The pair of four chamber stacks 1, 2 each with an effective membrane area of 1,500 sq. cm. are operated at a current density of 100 ma/sq.cm. The primary and secondary desalting stacks 3, 4 comprise 120 and 30 cell pairs respectively, with each having two electrical stages operating at a current density of 6 and 2 ma/sq.cm. and 0.8 and 0.3 ma/sq.cm. respectively.

EXAMPLE II

This example is operated in the manner of Example I using a waste solution of 0.11 normal (N) $HNO_3$ and $0.11\times10^{-10}$ normal in cesium at a flow rate of 682 ml./min.

EXAMPLE III

This example is operated in the manner of Example I on a waste solution of 0.1N acid and $0.1\times10^{-10}$N cesium at a flow rate of 597 ml/min.

As noted in the drawing, the letters enclosed in circles illustrate the various points in the flow scheme where the solution is monitored. The following table lists the flow rates and normality of the acid and cesium concentrations at monitored points for the three examples. It will be noted that the radwaste stream, point A, is treated to recover three separate streams, i.e., (1) a concentrated nitric acid stream, point Q, (2) a radioactive stream concentrated in cesium ions, point P, and (3) the largest volume stream of substantially deacidified and decontaminated product water, point Y. In addition, the water makeup, point R and the dilute feed stream to the primary desalting stack 3, point O, are important as previously described above.

TABLE (SUMMARY OF RESULTS)

| | Point | | | | | |
|---|---|---|---|---|---|---|
| | A | R | Y | Q | P | O |
| (EXAMPLE I) | | | | | | |
| Flow-Ml/min. | 289 | 60 | 283 | 56 | 10 | 288 |
| $HNO_3$—Normality | 0.27 | — | .001 | 1.3 | 0.57 | 0.1 |
| $Cs^+$ Normality | 0.27 | — | 0.0027 | — | 7.6 | 0.27 |

TABLE-continued (SUMMARY OF RESULTS)

| | Point | | | | | |
|---|---|---|---|---|---|---|
| | A | R | Y | Q | P | O |
| ($\times 10^{-10}$) | | | | | | |
| Ratio $Cs^+/H^+$ ($\times 10^{-10}$) | 1.0 | — | 2.7 | <0.01 | 13 | 2.7 |
| (EXAMPLE II) | | | | | | |
| Flow | 682 | 60 | 676 | 56 | 10 | 681 |
| $HNO_3$ | 0.11 | — | .00044 | 1.3 | 0.57 | 0.044 |
| Cesium ($\times 10^{-10}$) | 0.11 | — | .0011 | — | 7.5 | 0.11 |
| Ratio $Cs^+/H^+$ ($\times 10^{-10}$) | 1.0 | — | 2.5 | <0.01 | 13 | 2.5 |
| (EXAMPLE III) | | | | | | |
| Flow | 597 | 30 | 586 | 30 | 11 | 600 |
| $HNO_3$ | 0.1 | — | .0005 | 1.6 | 0.97 | 0.05 |
| Cesium ($\times 10^{-10}$) | 0.1 | — | .001 | — | 5.3 | 0.1 |
| Ratio $Cs^+/H^+$ ($\times 10^{-10}$) | 1.0 | — | 1.0 | <0.01 | 5.5 | 2.0 |

In each example, the reduction in the concentration of radioactive cations, such as cesium is 100-fold from the feed (at point A to the product (at point Y ). In addition, the pH of the product is greater than 3 (i.e. acidity is less than 0.001N).

Under example I, the feed acidity A which is relatively high (0.27N) is electrochemically neutralized in the deacidification stack 1 such that the acidity of the dilute stream feed O to stack 3 is 0.10N. Make-up water R is fed to the system at about 20% of the waste feed rate A to stack 1 such that the acidity of the anolyte Q increases to 1.3N. The cesium is concentrated in the catholyte P of the concentration stack 2 to about 28 times the concentration of cesium in the waste feed A to the deacidification stack 1.

Under Example II, the acidity of the waste feed to the deacidification stack 1 is reduced. This allows for increased production and allows the acidity of the dilute feed stream to stack 3 to decrease. As a result, the cesium in the catholyte effluent from stack 2 can be concentrated to about 68 times the waste feed concentration using the same addition rate of make-up water (i.e. 60 ml/mi). The make-up water as a percentage of the waste feed rate, however, is reduced to about 9% with the acidity of the anolyte maintained at about 1.3N.

Under Example III, the make-up water addition rate is cut to 30 ml/min, and the acidity of the anolyte Q increases to 1.6N. At approximately the same acidity in the waste feed as Example II (i.e. 0.10N vs. 0.11N), Example III is less efficient (because of the higher acidity in the make-up water recirculation stream). Both the production and the cesium concentration factor are somewhat reduced from those under condition B , i.e. (586 ml/min vs. 676 ml/min) and 53 times vs. 68 times, respectively.

The above examples clearly indicate the decontamination, deacidification, and acid concentration capability of the present invention.

The foregoing description of the invention has been directed to particular details in accordance with the requirements of the Patent Act and for purposes of explanation and illustration. It will be apparent, however, to those skilled in the art that many modifications and changes may be made without departing from the scope and spirit of the invention. It is further apparent that persons of ordinary skill in the art will, on the basis of this disclosure, be able to practice the invention within a broad range of process conditions. It is the intention in the following claims to cover all such equivalent modifications and variations as fall withing the true scope and spirit of the invention.

What is claimed is:

1. An apparatus for the removal and recovery of acidic and radioactive components of a liquid waste stream comprising in combination a series of at least two electrodialysis units or stacks, each stack comprised of a cathode chamber at one terminal end, an anode chamber at the opposite terminal end, said chambers containing respectively a cathode and anode electrode, a deacidification stack being the first stack in the series having all of its chambers being separated one from the other by separate anion selective membranes defining between said electrode chambers at least one neutral liquid chamber positioned adjacent to the cathode chamber, a primary desalting stack being the second stack in the series comprising a multi-chamber unit having a plurality of alternating salt diluting and salt concentrating chambers defined by alternating cation and anion selective membranes, means for introducing a liquid to be treated into the cathode chamber of said deacidification stack with exit means for withdrawal of said liquid, means for passing said withdrawn liquid into and out of the salt diluting chambers of said primary desalting stack, further means for introducing a liquid into and out of the concentrating and electrode chambers of said primary desalting stack and means for passing a direct electric current transversely across the membranes and chambers of each stack in the series.

2. The apparatus of claim 1 wherein additional multi-chamber units or secondary desalting stacks are located in series with said primary desalting stack with means for further passing said treated liquid successively into and out of the diluting chambers of each remaining stack and final means of withdrawal of a substantially deacidified and decontaminated product liquid stream from the last stack in series.

3. The apparatus of claim 1 wherein there is located in combination therewith a radioactive cation concentration stack of a similar configuration to said deacidification stack but having a cation selective membrane positioned facing the cathode chamber to define a single salt diluting chamber immediately adjacent thereto, said cation concentration stack having means for introducing at least a portion of the salt concentrated effluent stream of said primary desalting stack into said single salt diluting chamber with exit means for the withdrawal and the recycling of said resulting partially desalted stream from said single salt diluting chamber back to the salt concentrating chambers of said primary desalting stack.

4. The apparatus of claim 3 wherein said deacidification stack contains two neutral chambers between said electrode chambers and said radioactive cation concentration stack contains a neutral chamber adjacent the anode chamber and a salt diluting chamber adjacent the cathode chamber, means for passing a catholyte stream from the cathode chamber of said deacidification stack with further means for recycling the withdrawn liquid back as the influent stream to the said cathode chamber of said deacidification stack.

5. The apparatus of claim 4 wherein means are provided for recirculating a common anolyte stream through each of the anode chambers of said deacidification stack and said cation concentration stack with means for adding water to said common anolyte stream and further means for removing and recovering a concentrated acid solution from said recirculating anolyte stream.

6. A process for the removal and recovery of acidic and radioactive components of a liquid waste stream by the treatment of said waste stream through liquid treatment chambers of at least two electrodialysis stacks comprising the steps of first passing said waste solution through the cathode chamber of the first stack, a deacidification stack to reduce the acidity of said waste solution, said stack having terminally positioned anode and cathode chambers and at least one neutral liquid chamber therebetween, all chambers being separated one from the other by separate anion selective membranes, withdrawing catholyted solution from said cathode chamber and passing the same to the salt diluting chambers of the second stack, a multichamber primary desalting stack to reduce the salt content therein, said primary desalting stack having alternating cation and anion selective membranes defining alternating salt diluting and salt concentrating chambers, the terminal chambers of which contain cathode and anode electrodes, passing a direct electric current transversely through said membranes and chambers of said stacks and removing from the diluting chambers of said primary desalting stack a product water stream containing a substantially lessor amount of acid and radioactive cations than was originally present in said liquid waste system.

7. The process of claim 6 wherein said product water stream withdrawn from the diluting chambers of said primary desalting stack is passed in series flow through at least one secondary desalting stack to further reduce the acid and radioactive cations therein.

8. The process of claim 6 wherein the effluent stream from the salt concentrating chambers of said primary desalting stack is passed into a single salt diluting chamber of a radioactive cation concentration stack, said single salt diluting chamber positioned immediately adjacent the cathode chamber of said concentration stack and separated on that one side by a cation selective membrane with an anion selective membrane separating the other side of a said single diluting chamber, withdrawing from said single diluting chamber an effluent stream which has been partially desalted and recycling the same back to the salt concentrating chambers of said primary desalting stack.

9. The process of claim 6 wherein a first portion of the catholyte effluent solution from the cathode chamber of said cation concentration stack is passed into and out of the neutral chamber located adjacent the cathode chamber of said deacidification stack and thereafter recycled back as influent to the said neutral chamber.

10. The process of claim 9 wherein a second portion of said catholyte effluent is recycled back as the influent stream to the cathode chamber of said concentration stack and a third portion of said catholyte effluent is removed and recovered as a concentrated radioactive cation solution.

11. The process of claim 9 wherein an anolyte stream is recirculated through each of the anode chambers of the deacidification and cation concentration stacks while adding water to said anolyte to maintain the acid concentration at a desired level and removing and recovering a portion of said concentrated acid solution from said recirculating anolyte stream.

* * * * *